United States Patent [19]

Benuzzi

[11] Patent Number: 4,534,256

[45] Date of Patent: Aug. 13, 1985

[54] DEVICE FOR MAKING A GROOVE IN THE EDGE OF A PANEL

[76] Inventor: Gino Benuzzi, 5, Via Angelo Custode, Bologna, Italy

[21] Appl. No.: 434,812

[22] Filed: Oct. 18, 1982

[30] Foreign Application Priority Data

Oct. 20, 1981 [IT] Italy ..... 3554 A/81

[51] Int. Cl.[3] ..... B27B 5/00

[52] U.S. Cl. ..... 83/863; 83/471.1; 144/3 R

[58] Field of Search ..... 83/862–865, 83/471.1; 144/3 R

[56] References Cited

U.S. PATENT DOCUMENTS

| | | | |
|---|---|---|---|
| 4,058,150 | 11/1977 | Pennington | 83/862 X |
| 4,174,745 | 11/1979 | Benuzzi | 144/3 R |
| 4,181,164 | 1/1980 | Maniconi | 144/3 R |
| 4,245,390 | 1/1981 | Bond | 83/863 X |
| 4,308,777 | 1/1982 | Lawson | 83/863 X |

FOREIGN PATENT DOCUMENTS

| | | | |
|---|---|---|---|
| 1232800 | 5/1971 | United Kingdom . | |
| 666076 | 6/1979 | U.S.S.R. | 83/862 |

*Primary Examiner*—James M. Meister

*Attorney, Agent, or Firm*—Pollock, Vande Sande & Priddy

[57] ABSTRACT

A grooving device for making a groove or incision in the edge of panels (P) supported on a horizontal table for cutting by a said circular saw (S). The grooving device comprises a rotary grooving tool (30) mounted on the same carriage (C) as the main circular saw (S), on a movable side (12) of an articulated parallelogram structure (1,13, 11,12 to 9,10,14,15) mounted on the carriage (C) by means of another side (1) rigidly secured thereto. An air operated jack (17) moves the articulated parallelogram structure between a rest position in which the grooving tool (30) is inactive and a working position in which the grooving tool (30) engages the panels (P).

9 Claims, 9 Drawing Figures

DEVICE FOR MAKING A GROOVE IN THE EDGE OF A PANEL

SUMMARY OF THE INVENTION

The present invention relates to sawing machines for cutting panels and stacks of panels of material such as wood, particle board, hardboard, plywood or the like, which are veneered or laminated with plastic on one or both sides and along the edges. The sawing machine according to the invention is of the type in which the panels are supported on a horizontal supporting table and a main circular saw effects the cutting in a vertical plane, moving across the said supporting table along a horizontal cutting line.

More particularly, this invention relates to a device which can be mounted on the machines used for cutting panels or stacks of panels of wood and/or other material, and which can make a groove or incision in the edge of the panel from which the circular cutting saw will exit upon completion of its operating stroke, and in advance of the cutting saw, so as to avoid any splintering by the action of the latter saw. Unlike prior art devices, the device according to the invention is mounted on the same carriage on which the cutting tools are mounted, is provided with feeler means to follow and "copy" the contour of the edge of the panel or stack of panels, and operates in combination with the operative translatory movement of said carriage and, therefore, avoids dead time in the working cycle of the sawing machine.

In order to effect a neat kerf, free from any splintering, in panels of wood and/or other material, even if laminated completely with plastic and having any edge contour, for example a curved contour, such as panels designed to constitute doors and shelves for kitchen furniture, it is presently known to mount on the cutting machines a device adapted to effect in the edge of the panel from which the circular saw will exit upon completion of the cutting operation, and in advance of the circular saw, a groove of suitable depth and width, whereby the grooved material is subjected to compression, and not to tearing outwards by the teeth of the circular saw. This grooving device, which will be termed "supplementary" hereinafter to distinguish it from the scoring device which is usually mounted on the carriage and on the same mechanism mounting the circular saw, is presently associated fixedly with the frame of the cutting machine and is provided with its own activating means. This arrangement of the supplementary grooving device results in a considerably longer cutting mechanism structure, and entails a considerable dead time in the cutting cycle, because obvious and unavoidable safety reasons dictate that the carriage carrying the cutting tools be started only after the supplementary grooving device has terminated its working stroke. A grooving device of this type is illustrated in U.S. Pat. No. 4,174,745 of the present applicant.

This invention is intended to overcome the above drawbacks, by mounting the supplementary groove device on the same carriage mounting the cutting tools, and by providing other improvements that will be apparent from the succeeding description of a preferred embodiment of the assembly, which will be described with reference to the accompanying drawings.

DESCRIPTION OF THE PREFERRED EMBODIMENT

Figure 2:
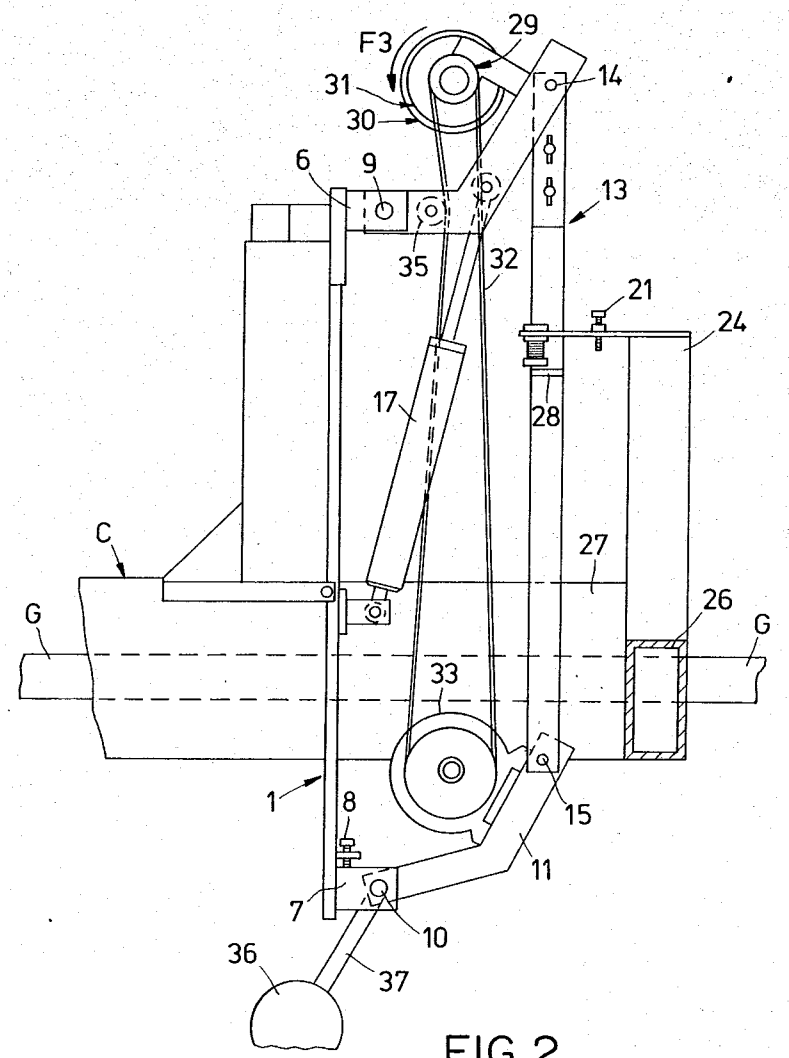
FIGS. 1 and 2 are two side elevational views, in the rest condition and on completion of the working stroke, respectively, of the grooving device according to the invention.
Figure 1:
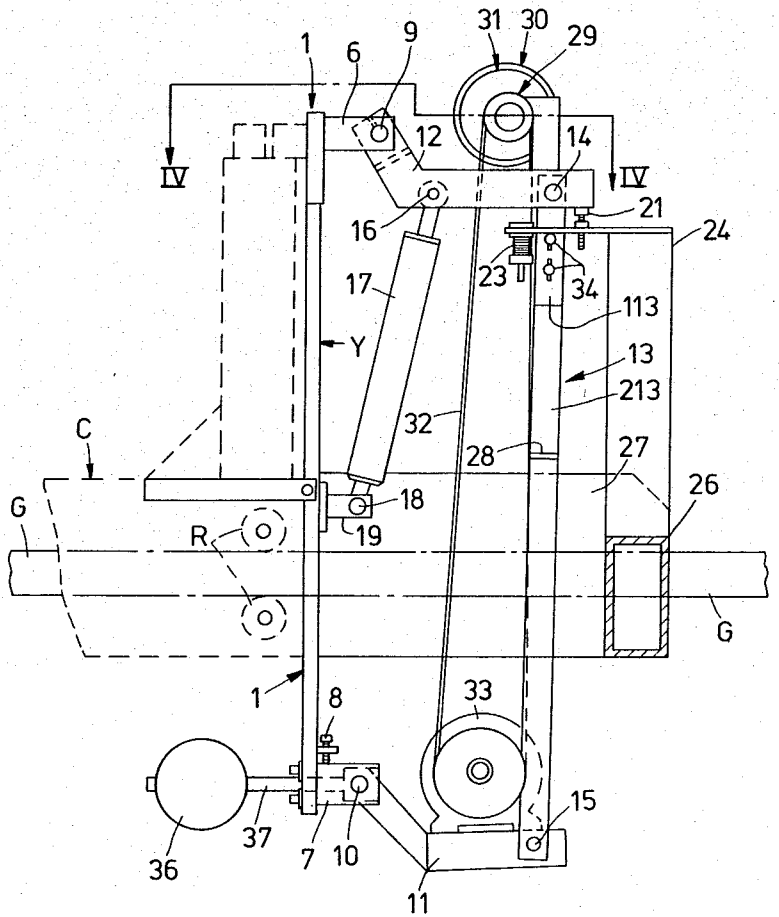
Figure 3:
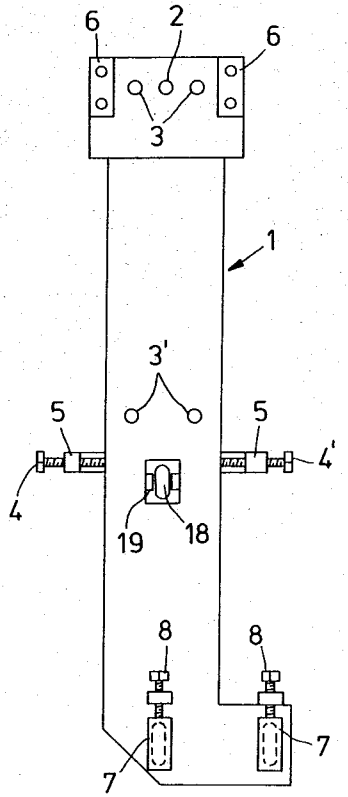
FIG. 3 is a front view, in the direction of the arrow Y in FIG. 1, of the plate member connecting the grooving device to the tool-mounting carriage of the cutting machine.

With reference to FIG. 1, reference letter C designates a portion of the carriage of a cutting machine, which through the rollers R moves with a precision fitting on rectilinear guides G. According to the invention, mounted on the front side of the carriage C, with respect to the active working direction thereof, is a vertically arranged plate 1 the front face of which is shaped as shown in FIG. 3. In order to permit the supplementary grooving device to be mounted aligned and centered exactly with respect to the cutting tools on the carriage C, adjustment means are provided one of which permits adjustment of plate 1 transversely to the direction of movement of the carriage, with pivotal movement on the upper fulcrum 2. By loosening the screws 3, 3' passed through elongated slots in the plate 1 and intended usually to secure the plate to the carriage C, and by operating on the adjustment screws 4, 4' mounted on projections 5, 5' secured to the carriage, the plate 1 can be adjusted accurately. Two pairs of bifurcated means 6 and 7 are secured to the upper end and lower end, respectively, of the plate 1, the lower pair being adjustable for movement to and from the upper pair by means of adjustment screws 8. Pivoted at 9 and 10 to the supporting means 6 and 7, there are respective structures 11 and 12 interconnected by a tie rod 13 pivoted thereto at 14 and 15. The pivot points 9, 10, 14 and 15 are parallel to the working plane of the cutting machine and are perpendicular to the direction of movement of the carriage C, the distance between the pivots 9 and 14 being the same as the distance between the pivots 10 and 15, and the distance between 9 and 10 being the same as the distance between 14 and 15, so that this structure constitutes an articulated parallelogram. Pivoted at an intermediate position 16 of the structure 12 is the rod of a pneumatic jack 17 the body of which is pivoted at 18 to a support member 19 integral with the plate 1. By means of the jack 17, said articulated parallelogram structure can be moved from the rest position shown in FIG. 1 to the maximum extended active position shown in FIG. 2, and vice versa, adjustable limit stops being provided for this purpose. When the device is at rest, the structure 12 abuts against the adjustable stop 21. During the final portion of the lifting movement of the articulated parallelogram structure, the latter co-operates with a shock absorber to dampen the movement of said structure, whereby if this movement occurs with no resistance, that is with no material to be grooved by the grooving device, the carriage C will not be subjected to any shock or vibration that might impair the operation of the cutting tools. The shock absorber 23 is, for example, of hydraulic type and is mounted on a support 24 which is secured to a tubular crosspiece 26 supported by the side frames 27 of the carriage C. A projection 28 integral with the tie rod 13 co-operates with the stem of the shock absorber 23. On completion of the lifting stroke of the device, the projection 28 co-operates with an adjustable stop member associated to the body of the shock absorber 23.

The tubular crosspiece 26 is used to form a reservoir containing sufficient compressed air to operate the jack 17, so that the operation of this apparatus is smooth and continuous regardless of any fluctuations and/or temporary interruptions in the compressed air source.

On the structure 12 there is mounted a mandrel 29 holding the grooving tool 30 and the feeler device 31 (to be described hereinafter) and mechanically connected, through a drive belt 32, to a motor 33 mounted on the structure 11. The distance between the axis of the mandrel 29 and the shaft of the motor 33 is the same as the distance between the pivots 14 and 15 and 9 and 10, respectively thus avoiding any stretch or slack in the belt 32 during the movement of the articulated parallelogram structure supporting the supplementary grooving device of the invention. In order to facilitate the replacement of the belt 32 and to permit the latter to be suitably stretched, the length of the tie rod 13 is adjustable. For this purpose, the tie rod 13 is formed, for example, by two parts 113, 213 interconnected by screws 34 passed through elongated slots in one of the said parts of the tie rod. It can be noted from FIG. 2 that during the last portion of the lifting stroke of the articulated parallelogram structure, the belt 32 co-operates with a small idle roller 35 mounted on the structure 12, thus avoiding any undesired interference between the belt and the panel. However, it is to be understood that the mandrel 29 could alternatively be connected to the motor 33, so as to avoid any distortion of the belt 32. The motor can be arranged, for example, on the same structure 12 mounting the grooving device; or the belt 32 can be connected to an idle double pulley mounted on the structure 12 and driving a second belt, for actuating the mandrel. These and other embodiments do not depart from the scope of the invention, in that they are obvious to any person skilled in the art.

To facilitate the actuation of the articulated parallelogram structure by the jack 17, and to make this actuation as smooth and quick as possible, a balance weight 36 is mounted on an arm 37 secured to the lower structure 11 and extending beyond the pivotal connection 10.

Figure 4:
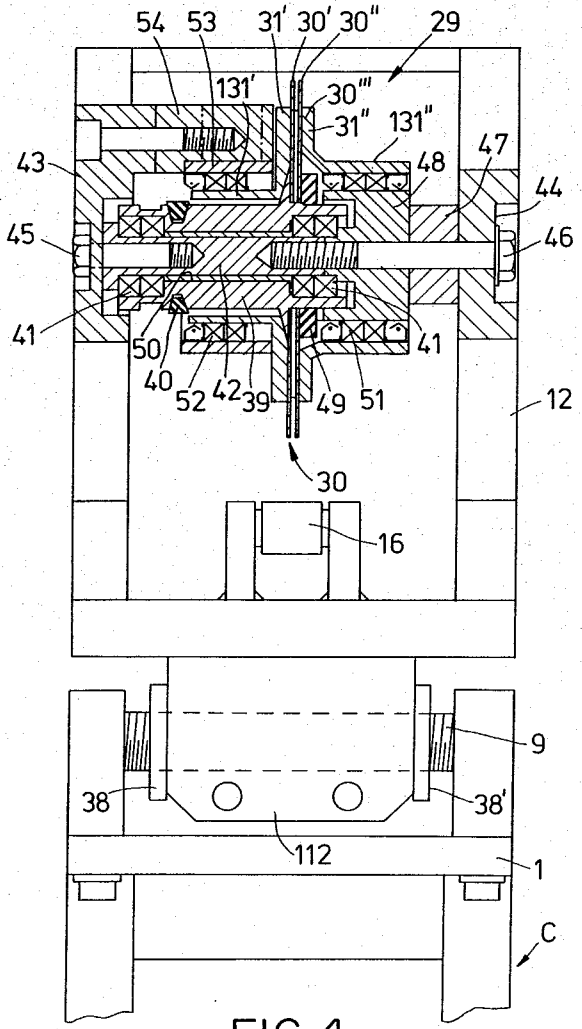
FIG. 4 is a view of further constructional details of the grooving device, on the section line IV—IV of FIG. 1.

With reference to FIG. 4, the device according to the invention is also provided with a further control system for aligning and centering the groove with the tools on the carriage C. The pivot 9 is formed by a screw supported at the end portions thereof by the support means 6, and a clamp 112 integral with the structure 12 is slidably mounted on this screw. Two ring nuts 38, 38', arranged at both sides of the clamp 112, co-operate with the screw 9. By loosening the clamp and adjusting the ring nuts 38, 38', the structure 12 can be adjusted transversely with great precision.

Figure 5:
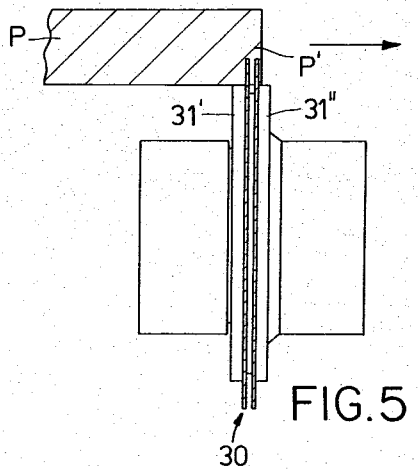
FIGS. 5 and 6 are front views of the grooving device, in two different operative positions.
Figure 6:
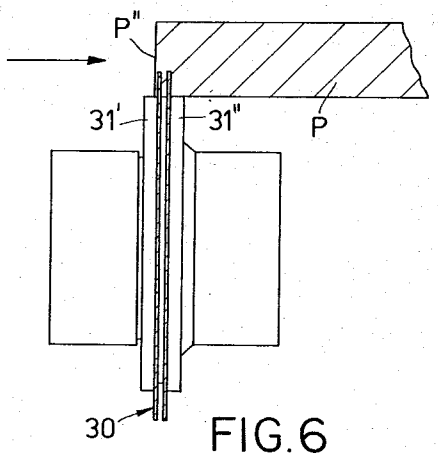

Still with reference to FIG. 4, it will be noted that the grooving tool 30 is preferably of double type as illustrated for example in the U.S. Pat. No. 4,174,745 (Benuzzi) for the purpose of making grooves of constant width when the working depth of the tool 30 is changed, and for the purpose of enabling the tool 30 to effect scores whose width can be adjusted to match the cutting groove effected by the circular saw, as the thickness of the tools is reduced as a result of the sharpening thereof. The two circular saws forming the grooving tool 30 are indicated by reference numerals 30' and 30'', and the spacers between the blades are indicated at 30'''. The saws 30'–30'' are mounted on a body 39 provided with a circular groove 40 to cooperate with the belt 32 and rotatable, through bearings 41, on a hub 42 which is secured to support members 43, 44 fixed to the structure 12. The numerals 45 and 46 indicate the screws securing the hub 42 to the support member 43, 44. By removing the latter screw 46, the spacer 47 and body 48 can be removed to give access to the ring nut 49 that locks the set of blades and interposed spacers forming the supplementary grooving device 30 on said body 39. The numeral 50 indicates a further spacer ring that can be used to set up the bearings 41. Still with reference to FIG. 4, it will be noted that also the feeler device 31 is of double type, i.e. it is formed by two circular freely-rotatable discs 31', 31'' of the same diameter, co-axial with the grooving device at either sides thereof. In FIGS. 5 and 6, it will be seen that, due to the action of the double feeler device, the grooving device will be positioned firmly and exactly also during the trimming of the front side P' and rear side P'' of the panels P, even if these front and rear sides are of small width, because either one of the feeler discs will always be contacting a suitable portion of the panel. The feeler disc 31'', with the body 131'' thereof, is rotatably supported by the body 48 through bearing 51, while the body 131' of the other feeler disc is rotatably supported through bearings 52 by an outer ring 53 which is fixed, for example by welding, to a body 54 connected to the support member 43. The support members 43, 44 are adjustably mounted on the structure 12, so as to ensure an exact positioning of the grooving device, as stated above in connection with the other adjustment provisions.

The operation of such a device is simple and apparent. When the carriage C is effecting its active or working stroke, the grooving device is at rest as shown in FIG. 1.

Figure 7:
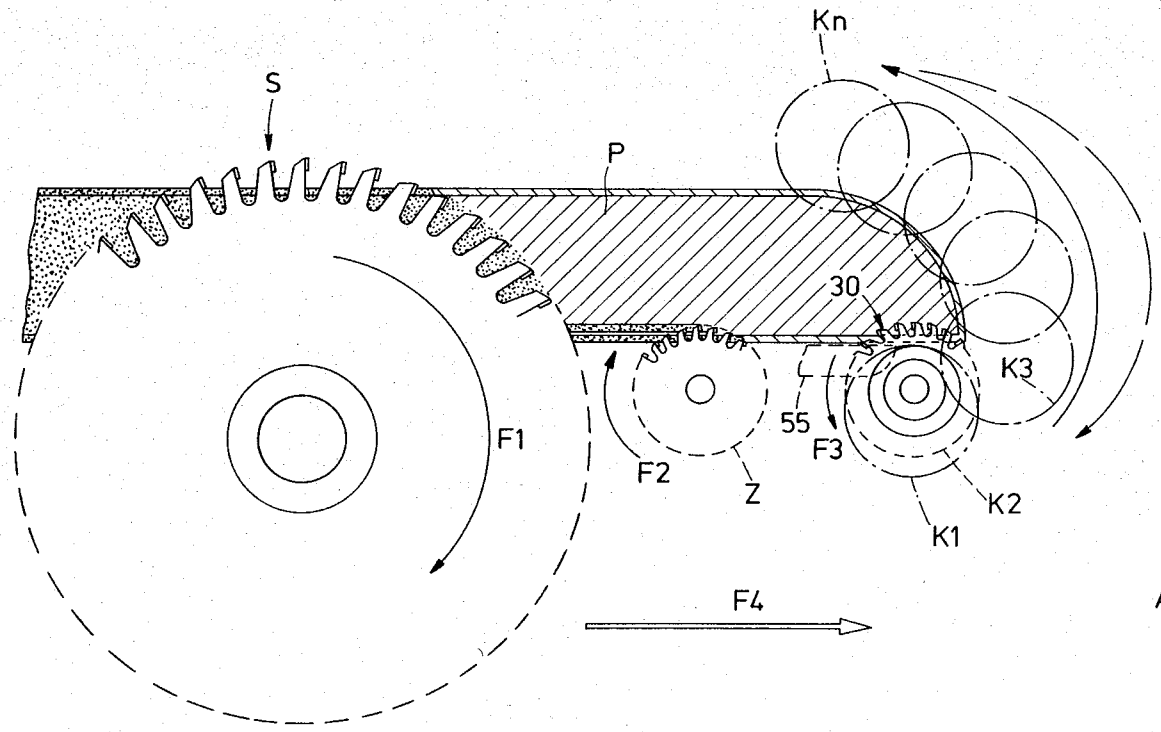
FIG. 7 is a side view of the grooving device while in operation in combination with the other tools of the cutting machine.

As shown in FIG. 7, the circular saw S and the associated scoring device Z, either of single blade or of double blade type, are both mounted on the carriage C in a known manner (see, for example, applicant's British Pat. No. 1,232,800). The directions of rotation of the saw S and scoring device Z are indicated by F1 and F2, respectively but it is to be understood that the direction of rotation of the scoring device is not of the essence of the invention.

Figure 8:
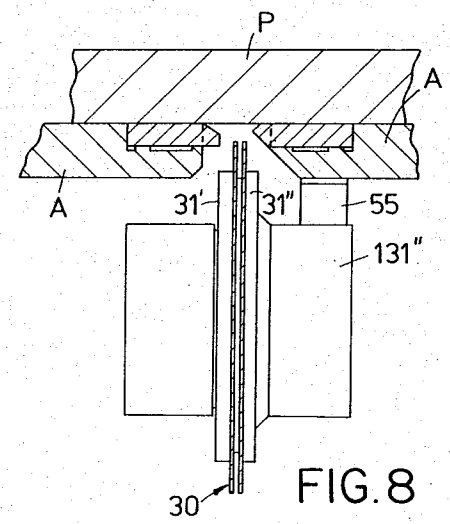
FIGS. 8 and 9 are front and partly sectional views of the supplementary grooving device, in two different positions and at the beginning of the working cycle thereof.
Figure 9:
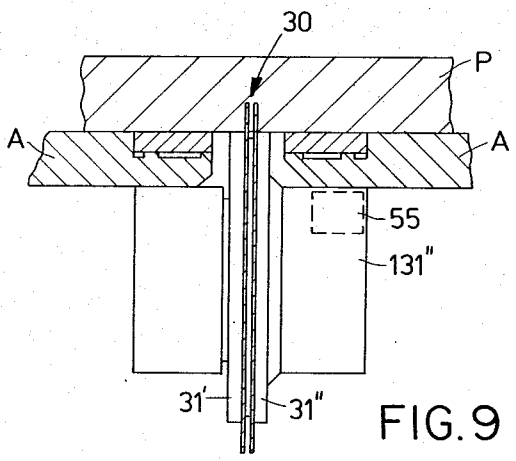

When the carriage C is about to reach the end of its working stroke, it actuates a micro-switch (not shown) that controls the extension of the jack 17. The grooving device 30 is preferably already activated and is rotating at an appropriate speed in the direction indicated by the arrow F3. The body 131 of the feeder disc 31'' slides on a linear cam 55 fixed below the work table A (see FIG. 8) and having a progressively tapered profile, so that the feelers 31' and 31'' will engage the panel P progressively, whereby the grooving device 30 will score the panel progressively and with no shock, as can also be seen in FIG. 9. It is to be understood, however, that other cams can be provided in addition to the cam 55 to achieve the object specified above. From the position K1 (FIG. 7), the grooving device moves to the position K2 and then to the position K3, and so on to the position Kn, so as to groove completely the edge of the panel P, without any interference with the tools S and Z which will continue rotating and translating as indicated by the arrow F4.

Due to the feelers, the device according to the invention will operate appropriately even on sinuous contours and on panels of limited thickness, with no risk that the groove will pass through the thickness of such panels.

The supplementary grooving device will be maintained in the limit position of its active stroke until the carriage C has reached the end of its working stroke, and will take advantage of the same control means for lowering and deactivating the tools S and Z, in order to cause the jack 17 to retract. Finally, easily conceivable safety means will be provided whereby the carriage C is activated to return to its starting position only when the supplementary grooving device has moved back to its rest position and when the tools S and Z have moved back to their lower position of rest.

I claim:

1. In a sawing machine for cutting panels (P) and the like, of the type in which said panels (P) are supported on a horizontal table (A) and a main circular saw (S) mounted on a movable carriage (C) effects the cutting in a vertical plane and moves across said table (A) along a horizontal cutting line, and having a grooving device for making at least one groove or incision in the edge of said panels (P) at the line of exit of said circular saw (S) out of said panels (P), the improvement wherein said grooving device comprises at least one rotary grooving tool (30) mounted on the same carriage (C) as said main circular saw (S) for movement therewith, and being guided by feeler means (31', 32'') along a path corresponding to the contour of an edge of a said panel being cut, and wherein said rotary grooving tool (30) is mounted on a movable side (12) of an articulated parallelogram structure (1, 13, 11, 12–9, 10, 14, 15) mounted on said carriage (C) by means of another side (1) rigidly secured thereto, means (17) being provided for moving said articulated parallelogram structure between a rest position in which said grooving tool (30) is inactive, and a working position in which said grooving tool (30) engages said panels (P).

2. Improvement according to claim 1, wherein the side (1) of said articulated parallelogram structure secured to said carriage (C) is arranged vertically, and said grooving tool (30) is mounted on the upper side (12) of the said articulated parallelogram structure.

3. Improvement according to claim 1, comprising means (2, 3, 4, 5) for adjusting the position of the side (1) of said articulated parallelogram secured to said carriage (C) in order to effect alignment and correct positioning of said groove tool (30) with respect to said main circular saw (S).

4. Improvement according to claim 1, wherein said means for moving said articulated parallelogram structure comprise a fluid operated jack (17) one end of which is hinged to the side of said parallelogram structure secured to said carriage, while the other end is hinged to the movable side carrying said rotary grooving tool (30).

5. Improvement according to claim 1, wherein said feeler means (31', 31'') are mounted for free rotation on each side of rotary grooving tool (30) and coaxially to its rotational axis, said feeler means following the contour of the edge of said panel.

6. Improvement according to claim 5, comprising at least one linear cam (55) on the underside of said table (A) on at least one side of the cutting line adjacent the edge of a panel to be grooved, said at least one cam (55) having a progressively tapered profile and cooperating with a cylindrical body portion (131) of said feeler means.

7. Improvement according to claim 1, wherein said rotary grooving tool (30) comprises two circular saws (30', 30'') coaxially mounted and spaced from each other by an interposed interchangeable spacer element (30''').

8. Improvement according to claim 1, comprising a shock absorber (23) of hydraulic type for dampening the final portion of the movement of said articulated paallelogram structure into working position.

9. Improvement according to claim 4, wherein said fluid-operated jack (17) is a compressed air operated jack, a compressed air reservoir (26) being provided on said carriage (C) for the actuation of said jack (17), said reservoir (26) being obtained by utilizing a tubular structure mounted on the carriage itself and constituting part of frame portion of said grooving device.

* * * * *